US006216661B1

(12) United States Patent
Pickens et al.

(10) Patent No.: US 6,216,661 B1
(45) Date of Patent: Apr. 17, 2001

(54) FILTERED CARBURETOR COVER

(76) Inventors: Randy Pickens, 311 Westbury La., Florence, AL (US) 35630; Robert J. Dinges, 735 Jabo Dr., Killen, AL (US) 35645

( * ) Notice: Subject to any disclaimer, the term of this patent is extended or adjusted under 35 U.S.C. 154(b) by 0 days.

(21) Appl. No.: 09/538,745

(22) Filed: Mar. 30, 2000

Related U.S. Application Data

(60) Provisional application No. 60/127,358, filed on Apr. 1, 1999.

(51) Int. Cl.[7] ..... F02B 77/00
(52) U.S. Cl. ..... 123/198 E; 55/DIG. 28
(58) Field of Search ..... 123/198 E; 55/DIG. 28

(56) References Cited

U.S. PATENT DOCUMENTS

| | | | | |
|---|---|---|---|---|
| D. 151,464 | | 10/1948 | Olsen . | |
| D. 157,443 | | 2/1950 | Sebok et al. . | |
| D. 178,812 | | 9/1956 | Sebok . | |
| D. 213,403 | | 2/1969 | Kraus . | |
| D. 293,796 | | 1/1988 | Nagy . | |
| D. 295,444 | | 4/1988 | Sundqvist . | |
| D. 399,944 | | 10/1998 | Gillingham et al. . | |
| 1,829,401 | * | 10/1931 | Kamrath | 55/DIG. 28 |
| 2,761,527 | | 9/1956 | Dreznes . | |
| 4,168,694 | * | 9/1979 | Nett | 123/198 R |
| 5,307,771 | | 5/1994 | Stahel, II et al. . | |
| 5,368,621 | | 11/1994 | Pool . | |
| 5,582,146 | | 12/1996 | Linsbauer et al. . | |
| 5,688,299 | | 11/1997 | Goodwin . | |
| 5,706,777 | | 1/1998 | Shlessmann et al. . | |
| 5,720,788 | | 2/1998 | Puckett et al. . | |
| 5,755,843 | | 5/1998 | Sundquist . | |

FOREIGN PATENT DOCUMENTS

| | | |
|---|---|---|
| 2701656 | 8/1994 | (FR) . |
| 4-269365 | 9/1992 | (JP) . |
| 2006653 | 1/1994 | (RU) . |
| 1679045 | 9/1991 | (SU) . |
| 1772392 | 10/1992 | (SU) . |

* cited by examiner

*Primary Examiner*—Noah P. Kamen
(74) *Attorney, Agent, or Firm*—Richard C. Litman

(57) ABSTRACT

A filtered carburetor cover is temporarily and removably secured to the carburetor throat of a motor vehicle internal combustion engine, for precluding passage of significant amounts of dirt, dust, and foreign matter into the engine intake system while the engine is run. The cover is preferably no larger, or not significantly larger, than the lateral dimensions of the carburetor to which it is secured. The relatively small size of the present carburetor cover allows complete access to the external adjustable components of the carburetor with the cover installed. The cover comprises a generally cylindrical housing having impermeable sides and a porous top, with one or more filtering elements in the top. The filtering elements preferably comprise one or a few sheets of finely woven stainless steel or other metal screen, or a woven synthetic fabric mesh material, for keeping significant amounts of undesirable material out of the engine while it is running without significantly impeding airflow through the carburetor and engine. The present carburetor cover is particularly well suited for use with racing vehicles, where the engines of such vehicles must generally be adjusted and tuned while the vehicles are at race events. The conventional air cleaner used with such vehicles is relatively large, to permit significant airflow therethrough without undue restriction. The large size of such air cleaners precludes ready access to the carburetor thereunder. Thus, the standard air cleaner is removed and the present carburetor cover installed, to permit carburetor adjustment with the engine running.

19 Claims, 4 Drawing Sheets

FILTERED CARBURETOR COVER

REFERENCE TO RELATED PATENT APPLICATION

This application claims the benefit of U.S. Provisional Patent Application Ser. No. 60/127,358, filed on Apr. 1, 1999.

BACKGROUND OF THE INVENTION

1. Field of the Invention

The present invention relates generally to devices for cleaning and filtering materials, and more specifically to a relatively small, removable, temporary carburetor cover for short term installation on a carburetor. The present cover includes filtering means therein, so the engine may be run for carburetor tuning and adjustment purposes with the cover in place, to prevent the ingestion of foreign matter (dirt, small parts, etc.).

2. Description of the Related Art

While nearly all motor vehicles used in street operation are equipped with fuel injection systems for better exhaust emissions control, better flexibility under various conditions (cold starting, better fuel distribution, etc.), there are many classes of off-road motor vehicles which still use carburetors, due to the rules governing those various classes.

This is particularly true of motor vehicles used in racing (i.e., race cars of various types), ranging from so-called "hobby stocks" up to racing automobiles used in major league Winston Cup racing. Most racing classes for full-bodied cars, as well as certain classes of open wheel cars which run in various minor league series, are required to use carburetors for their fuel distribution systems, rather than fuel injection.

Air intake filter systems for motor vehicle carburetors are typically secured directly to the mouth of the carburetor, with no intervening intake system. Such filters are generally relatively large in comparison to the carburetor diameter, in order to provide a relatively large filter area to produce a relatively low restriction for air passing through the filter and its housing. Accordingly, the typical filter housings of such carburetors extend well beyond the lateral dimensions of the carburetor.

This is ordinarily not a serious problem, as access to the carburetor is obviously not required while the vehicle is in motion. However, access to the carburetor is required when the engine is being tuned or adjusted, for adjusting fuel/air mixtures, adjusting the point at which the secondary throttles begin to open in multiple barrel carburetors, etc. Many such adjustments may be accomplished while the engine is running, and in fact, it can be quite difficult to accurately accomplish many such adjustments when the engine is shut down. Yet, the conventional air cleaner must be removed from the carburetor for access to the various adjustment points.

This may not be a significant problem under some circumstances, but the removal of the air cleaner from a carburetor while the engine is running in a relatively dirty environment can lead to the ingestion of dirt and other foreign matter into the engine, which is always harmful to the engine and may be disastrous. This is particularly true in many automobile racing environments, particularly on dirt tracks and even at a paved track with a dirt or turf infield area where the cars are being worked on before or between races. The amount of dirt and dust which is kicked up into the air by a number of racing automobiles in such an environment is considerable, and in fact often reaches an extent to which the dust and dirt is quite visible in the air at such tracks during racing events. As an operating engine performs as a pump, drawing air from the atmosphere through the carburetor and into the engine, it will be seen that a considerable amount of dirt and dust may enter a carburetor and engine during the time the engine is running in relatively dirty air.

In addition to the above considerations, racing mechanics are always pressed for time, and it is quite easy under such circumstances to inadvertently drop a small part which may fall into the carburetor throat and thence be ingested into the engine, where it almost always causes considerable damage. Even if the mechanic realizes such a part has been dropped into the carburetor throat, there may be insufficient time to shut down the engine before the part passes into one of the cylinders and causes internal damage to the engine.

Even if the engine is not operating when such foreign matter is dropped into the carburetor, often the engine intake system must be disassembled for recovery of the part. Such disassembly obviously requires additional time, which is seldom available at a race. Accordingly, almost all mechanics will cover the carburetor throat when the air cleaner is removed, in order to preclude the entry of dust and dirt therein and the dropping of any foreign objects into the carburetor throat when the engine is not running.

However, such cover plates do not allow the passage of any air therethrough, and thus cannot be used when the engine is running. The only solution is to keep the conventional, relatively large air cleaner in place, or to remove it for adjustments to the carburetor and hope that no significant amount of dust, dirt, or foreign matter passes through the carburetor during the time the air cleaner is removed.

Accordingly, a need will be seen for a filtered carburetor cover which may be temporarily installed on a carburetor throat when the conventional air cleaner or screen is removed. The present carburetor cover is relatively small and has a diameter substantially the same as, or at least no larger than, the carburetor with which it is used, in order to provide access to the external components of the carburetor for adjusting and tuning while the engine is running. The present carburetor cover includes filter elements in the intake portion thereof, to preclude the ingestion of any significant amount of foreign matter into the engine while it is running.

A discussion of the related art of which the present inventor is aware, and its differences and distinctions from the present invention, is provided below.

U.S. Pat. No. 2,761,527 issued on Sep. 4, 1956 to John J. Dreznes, titled "Filter Body," describes a relatively large and bulky air filter, resembling the conventional oil bath filter used commonly up to the 1960s. the Dreznes filter includes a fitting for installing over the throat of a carburetor, with the fitting being defined by a clamping ring 41 therearound. The clamping ring has a considerably smaller diameter than the body or housing of the air cleaner, as may be readily seen in FIG. 3 of the drawings of the Dreznes Patent. Accordingly, the sides of a carburetor over which the Dreznes air cleaner is installed, cannot be readily accessed. The present filtered carburetor cover is not intended for use during normal engine operation, but as the name indicates, is a cover with a filter therein for use in tuning and adjustment operations and which provides full access to the external components of the carburetor.

U.S. Pat. No. 5,307,771 issued on May 3, 1994 to Alwin J. Stahel II et al., titled "Motorcycle Air Cleaner," describes an air cleaner assembly having a secondary throttle assembly on one side thereof. The assembly is operated by manifold vacuum from the engine, and is set to open when manifold pressure increases, i.e., when the throttle is opened for increased engine power. This provides a larger intake area to the air filter, thus producing less restriction to the filter for better engine "breathing." As noted further above, this is the reason that conventional air cleaners are relatively large in comparison to the carburetor diameter, i.e., to provide a significantly larger cross sectional area for the air cleaner element in order to compensate at least partially for the restriction of the air cleaner element. The Stahel II et al. air cleaner body extends well beyond the outer dimensions of the carburetor, as can be seen in the cross section of FIG. 2A of the Stahel II et al. Patent. In contrast, the present filtered carburetor cover preferably extends no further than the outer dimensions of the carburetor, in order to allow complete access to the carburetor as required when the filter cover is installed thereon.

U.S. Pat. No. 5,368,621 issued on Nov. 29, 1994 to Stephen R. Pool, titled "Filtering Air Cleaner Cover For Internal Combustion Engine," describes a conventional, relatively large diameter air cleaner in which the impervious top cover has been replaced with an additional filter element. Here again, Pool recognizes the restriction of the typical air cleaner element and the need to provide the greatest practicable inlet area through such air cleaner elements. The air cleaner housing with which Pool uses his filter cover is a relatively large diameter device, as evidenced by the relatively small size of the engine inlet 14b shown in FIG. 1 of the Pool U.S. Patent. The Pool air filter housing thus extends well beyond the dimensions of any carburetor or other intake system to which it is attached, rendering access to adjustment features thereof, impossible while it is installed.

U.S. Pat. No. 5,582,146 issued on Dec. 10, 1996 to Peter Linsbauer et al., titled "Suction Air Filter," describes a filter for an internal combustion engine, with the filter including multiple air cleaner elements in series therein. The Linsbauer et al. filter is not intended for maximum power production, as can be seen from the multiple filter elements and their restriction to air flow. The exemplary filter unit is shown installed on an internal combustion engine powered cutoff saw, which obviously produces a considerable amount of debris when in use, hence the need for optimum air filtration as opposed to maximum power. Accordingly, the filter housing 3 has a considerably larger diameter than the carburetor 1, as is clearly shown in FIG. 2 of the Linsbauer et al. U.S. Patent. Accordingly, access to the external adjustment components of a carburetor to which the Linsbauer et al. filter assembly is secured, is extremely difficult, if not impossible.

U.S. Pat. No. 5,688,299 issued on Nov. 18, 1997 to Thomas I. Goodwin, titled "Air Filters," describes a low, generally cylindrical filter having side and top filter elements. The top element precludes access to the conventional central filter housing attachment bolt. Accordingly, Goodwin provides for removal and installation of his filter by means of quick release fasteners (e.g., Dzus; tm, Camloc; tm, etc.), as used in the aviation industry. Goodwin recognizes the importance of the largest possible filter area for reducing air flow restriction as much as possible; hence, the top filter element in addition to the side element. The Goodwin filter is thus more closely related to the filter disclosed in the U.S. Patent '621 to Pool, than to the present filter cover invention. Accordingly, the Goodwin filter has a considerably larger diameter than the carburetor to which it is secured, as shown clearly in FIG. 2 of the Goodwin U.S. Patent. This renders any carburetor adjustments extremely difficult or impossible when the Goodwin filter is installed thereon, due to the inaccessibility of the carburetor due to the overhanging Goodwin filter. The substantially smaller diameter of the present filtered carburetor cover, while not providing the relatively large filter area of conventional filters, provides ready access to the various adjustable components of a carburetor to which the present filter cover is installed.

U.S. Pat. No. 5,706,777 issued on Jan. 13, 1998 to Helmut Schlessmann et al., titled "Suction Air Filter For A Combustion Engine With Diaphragm Carburetor," describes a generally conventional filter housing with a foam filter therein. The housing includes a bypass tube for compensating for decreased manifold pressure due to increased restriction of the filter element in the event the filter element becomes substantially clogged. The single drawing Figure clearly shows the filter housing as having a substantially larger diameter than the carburetor to which the housing is attached, unlike the present filtered carburetor cover. The problems of such a configuration in adjusting a carburetor to which such a filter is attached, and the solution provided by the present filtered carburetor cover, have been described above.

U.S. Pat. No. 5,720,788 issued on Feb. 24, 1998 to Ronald R. Puckett et al., titled "Air Filter Element And Air Filter Assembly Employing The Filter Element," describes a generally cylindrical or truncated conical filter element and housing therefor. The air inlet to the housing is offset from the centerline of the filter element, thus causing air to spiral about the filter element to some extent prior to passing through the element. Larger debris particles are trapped at the base of the filter element, within the housing. The Puckett et al. filter element and housing have a considerably larger diameter than the engine air inlet to which they are secured, as is shown clearly in FIG. 2 of the Puckett et al. U.S. Patent, thereby making access difficult to any carburetor to which the assembly is secured.

U.S. Pat. No. 5,755,843 issued on May 26, 1998 to Tommy Sundquist, titled "Air Filter With Reusable Gable Plate," describes a filter and housing with the filter end plates (gables) being removable from the filter element, which is discarded after a period of use. The filter (and housing) is relatively bulky, with the filter and housing extending far beyond the dimensions of the carburetor or other air inlet to the engine, as is shown clearly in FIG. 1 of the Sundquist U.S. Patent. Moreover, as in the case of the Puckett et al. U.S. Patent described immediately above, no top or axial flow through a filter element and directly into the engine intake system (carburetor throat, etc.) is possible with the Sundquist filter apparatus, which straight, axial flow path is the only flow direction permitted by the present filtered cover.

U.S. Pat. No. D-151,464 issued on Oct. 19, 1948 to Niels H. F. Olsen, titled "Air Filter," illustrates a design apparently having two outlet passages therefrom, for a dual carburetor system. The overall dimensions of the filter and housing are considerably wider than the outlet passages which would connect to the carburetor throats. Moreover, it would appear that the Olsen filter design permits only generally radial flow, as the top of the design appears solid, thus precluding any axial flow therethrough.

U.S. Pat. No. D-157,443 issued on Feb. 21, 1950 to Joseph B. Sebok et al., titled "Combination Air Cleaner And Intake Silencer Unit," illustrates a device having an appearance generally like the conventional oil bath air cleaners used in automobiles of the 1930s and into the 1950s. The outlet for connecting to the engine intake system extends from the side of the lower portion of the device, with the lower and particularly the upper portions of the device having diameters considerably larger than the engine intake connecting portion. The Sebok et al. design could not be used with downdraft type carburetors, due to the lateral engine intake connector, and no axial flow is apparent through the top of the Sebok et al. air cleaner design.

U.S. Pat. No. D-178,812 issued on Sep. 18, 1956 to Joseph B. Sebok, titled "Air Cleaner And Intake Silencer Unit Or Similar Article," illustrates a design apparently having only a few small louvers disposed in one side, for intake air. The connection to any engine inlet system is apparently smaller than the housing, with no air passage being apparent through the top of the design.

U.S. Pat. No. D-213,403 issued on Feb. 25, 1969 to Alex Kraus, titled "Air Cleaner Cover," illustrates a generally flat, circular sheet of material having a series of grooves formed diametrically across the top thereof. The exemplary air cleaner illustrated with the cover design is a circular type, with air entering radially through the sides thereof. The Kraus air cleaner cover design appears to be solid, thus precluding any air passage therethrough, unlike the present filtered cover invention which allows air to pass through the top thereof.

U.S. Pat. No. D-293,796 issued on Jan. 19, 1988 to Neil F. Nagy, titled "Air Cleaner Cover," illustrates a generally round design apparently having a rough cast or similar finish across the upper surface thereof, and extending partially down the sides. It is not clear where the air inlet area of the design is located, but a series of what appear to be slots is located in the rough finished area at each side of the design. No top passage for air ingestion is apparent in the Nagy design.

U.S. Pat. No. D-295,444 issued on Apr. 26, 1988 to Tommy Sundqvist, titled "Cover For An Automotive Air Filter Housing," illustrates a design comprising a generally flat, circular plate with slightly raised circular areas thereon. The plate appears to be solid, with no means for allowing airflow through the plate, as opposed to the present filtered carburetor cover with its inlet passage formed in the top thereof.

U.S. Pat. No. D-399,944 issued on Oct. 20, 1998 to Gary R. Gillingham et al., titled "Conical Filter," illustrates a design having a generally cylindrical exterior, with a flange at one end and a series of raised concentric marks opposite the flanged end. The air inlet and outlet portions and inlet attachment means of the Gillingham et al. filter are not apparent from the drawings of their design patent.

Soviet Patent Publication No. 1,679,045 published on Sep. 23, 1991 describes (according to the English abstract) an electrostatic air cleaner having dual electrostatic elements. FIG. 2 indicates that all air to the filter passes through a single radially disposed inlet in the generally circular housing, with the top of the housing apparently being solid to preclude passage of air therethrough, unlike the present filtered carburetor cover. Moreover, FIG. 2 appears to indicate that all air flowing through the filter, passes into a relatively smaller passage which apparently represents the engine intake system. Thus, the air cleaner of the '045 Soviet Patent Publication appears to be considerably larger than the carburetor or other engine inlet component to which it is attached, whereas the present filtered cover has a diameter which is not significantly larger than the carburetor to which it is secured.

Japanese Patent Publication No. 4-269,365 published on Sep. 25, 1992 describes (according to the English abstract) an air filter and housing assembly in which the housing is configured to provide some additional flow by its shape, forming a "suction port." FIG. 2 of the drawings clearly shows an inlet passage extending from the air filter housing, with the engine intake connecting end of the inlet passage being considerably smaller than the size of the air box. It would appear that if the assembly were connected to a carburetor, that it would be necessary to remove the assembly in order to perform any adjustment or other work on the carburetor, due to the size of the air box assembly.

Soviet Patent Publication No. 1,772,392 published on Oct. 30, 1992 describes (according to the English abstract) an air cleaner having an impermeable housing which surrounds and encloses the filter element on the sides and top, with air being taken in through passages in the bottom, according to the drawing Figures. The filter element fits circumferentially tightly about an engine inlet passage, and is considerably larger than the passage. Such a configuration would preclude any access to a carburetor to which such a filter assembly would be secured, as the attachment completely surrounds the inlet system, rather than securing to the top or inlet face thereof, as in the present carburetor cover. Moreover, the assembly of the '392 Soviet Patent Publication does not provide for any air flow through the top of the housing, axially into the inlet system, as provided by the present filtered carburetor cover.

Russian Patent Publication No. 2,006,653 published on Jan. 30, 1994 describes (according to the English abstract) a filter element having progressively finer passages toward the interior thereof. The filter shape is not apparent from the drawing Figure illustrating the filter element itself, and no housing or means of connecting the device to a carburetor or engine inlet is shown.

Finally, French Patent Publication No. 2,701,656 published on Aug. 26, 1994 describes (according to the English abstract) a filter housing adapted for accepting filters having either axial or radial seals. The housing is a generally cylindrical container having sides, bottom, and top which are completely closed and sealed, with the exception of a single radially disposed inlet and a single axial outlet extending from the bottom thereof to the engine inlet system. No means is apparent for ingesting air through the top of the housing, whereas the present filtered carburetor cover draws all air through a filter disposed in the top of the device. Also, the filter housing of the '656 French Patent Publication has a considerably larger diameter than the engine inlet or carburetor to which the device is attached, thereby making it difficult or impossible to access the carburetor with the filter attached. Also, as in the case of nearly every other filter of the prior art, the filter element of the '656 French Patent Publication is relatively large and bulky, unlike the thin, planar filter of the present invention.

None of the above inventions and patents, either singly or in combination, is seen to describe the instant invention as claimed.

SUMMARY OF THE INVENTION

The present invention comprises a filtered carburetor cover, for temporary and removable installation to the inlet or throat of a carburetor of a motor vehicle for precluding entry of foreign matter into the engine inlet system while the engine is running. Unlike other semipermanently installed air cleaners intended for use while the vehicle is in motion, the present carburetor cover is relatively small, having a diameter preferably about the same as, and not significantly larger than, that of the carburetor to which the device is temporarily secured. The present cover is also preferably relatively low, with its small dimensions providing ease of access to the carburetor to which the cover is secured for adjusting the carburetor while the engine is running.

The filter element is preferably a single layer, or at most a very few layers, of a finely woven metal screen (preferably stainless steel, although other materials may be used), or possibly a synthetic fabric mesh or other suitable material. Metal screen is preferred due to its fire resistance in the event of a backfire through the carburetor, and/or "spitback" of raw fuel through the carburetor during starting or other operation. The filter element is bonded in the top of the housing at the time of manufacture. The filter element does not provide the protection of a conventional semipermanently installed filter with its relatively thick filter medium, but serves well to preclude entry of significant dust, dirt, and foreign matter into the engine during tuning and adjustment operations, particularly for racing vehicles at a relatively dusty and dirty race event. The present filter cover may remain in place when the engine is shut down if desired, to provide further protection for the engine. The filter cover is preferably removed and a conventional filter installed for maximum filtering efficiency during vehicle operation.

Accordingly, it is a principal object of the invention to provide an improved filtered carburetor cover for temporary, removable installation to the carburetor of an engine, with the carburetor cover having a size permitting full access to the externally adjustable components of the carburetor while the present cover is installed thereon.

It is another object of the invention to provide an improved carburetor cover having a housing with an impermeable side portion and a porous top, with the top including filter means therein.

It is a further object of the invention to provide an improved filtered carburetor cover which filter means comprises one or a few plies of a closely woven metal screen, or synthetic fabric material or the like.

An additional object of the invention is to provide an improved filtered carburetor cover which is cast, molded, or otherwise formed of a plastic material.

Still another object of the invention is to provide an improved filtered carburetor cover which filter means is bonded in place in the top of the cover housing at the time of manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a filtered carburetor cover, for covering the throat of a carburetor on an internal combustion engine and precluding the entry of dirt and/or other foreign matter therein when the engine is running. The present filtered cover provides reasonable protection for the engine from contamination by foreign matter, yet is sufficiently small (preferably no larger, or not significantly larger, than the throat of the carburetor to which it is removably attached) so as to provide essentially complete access to various adjustment points of the carburetor to which it is secured.

Figure 1:
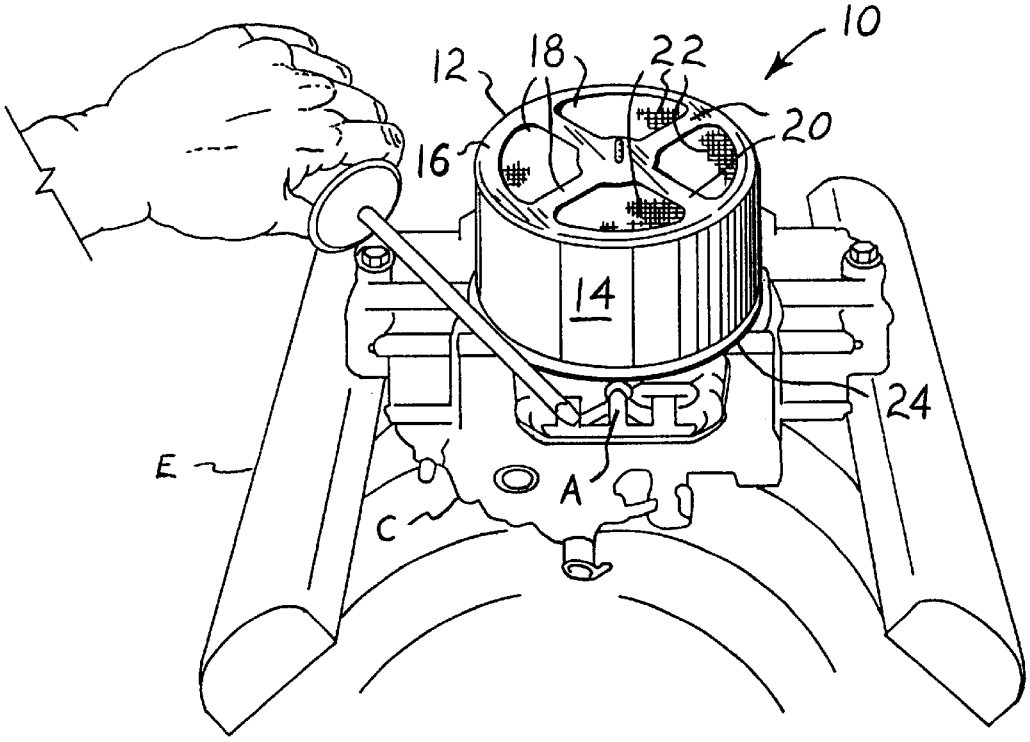
FIG. 1 is an environmental perspective view of the present filtered carburetor cover installed on an engine carburetor, showing the accessibility of the carburetor for adjustment.

FIG. 1 illustrates the present filtered carburetor cover 10 installed atop a carburetor C, which is in turn installed upon an internal combustion engine E. The carburetor cover 10 comprises a housing 12 with an impervious wall 14 which is impenetrable by air flow and any particulate matter which might be contained in such air flow. The wall 14 includes a first end 16 having at least one airflow inlet passage therethrough; preferably four such passages 18 are provided in quadrants in the first end 16 of the wall 14 or housing 12 and separated by radially disposed ribs 20 extending across the airflow inlet end 16 and defining the airflow inlet passages 18 therebetween. Each inlet passage 18 includes some form of air filtering means 22 installed therein. The opposite second, or airflow outlet end 24, is adapted to seal against the throat of the carburetor C and allow filtered air flowing through the filtered carburetor cover 10 to pass into the carburetor C.

Figure 2:
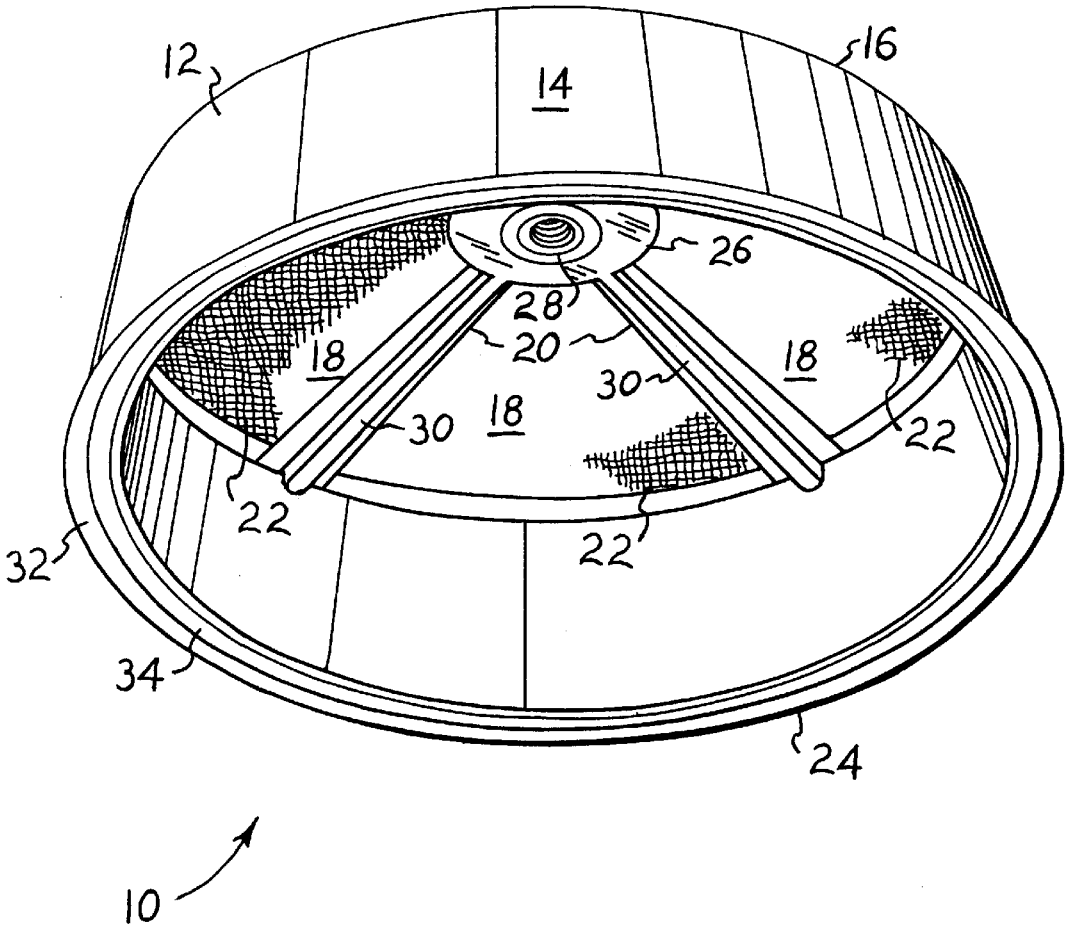
FIG. 2 is a bottom perspective view of the present filtered carburetor cover, showing details of its construction.
Figure 3:
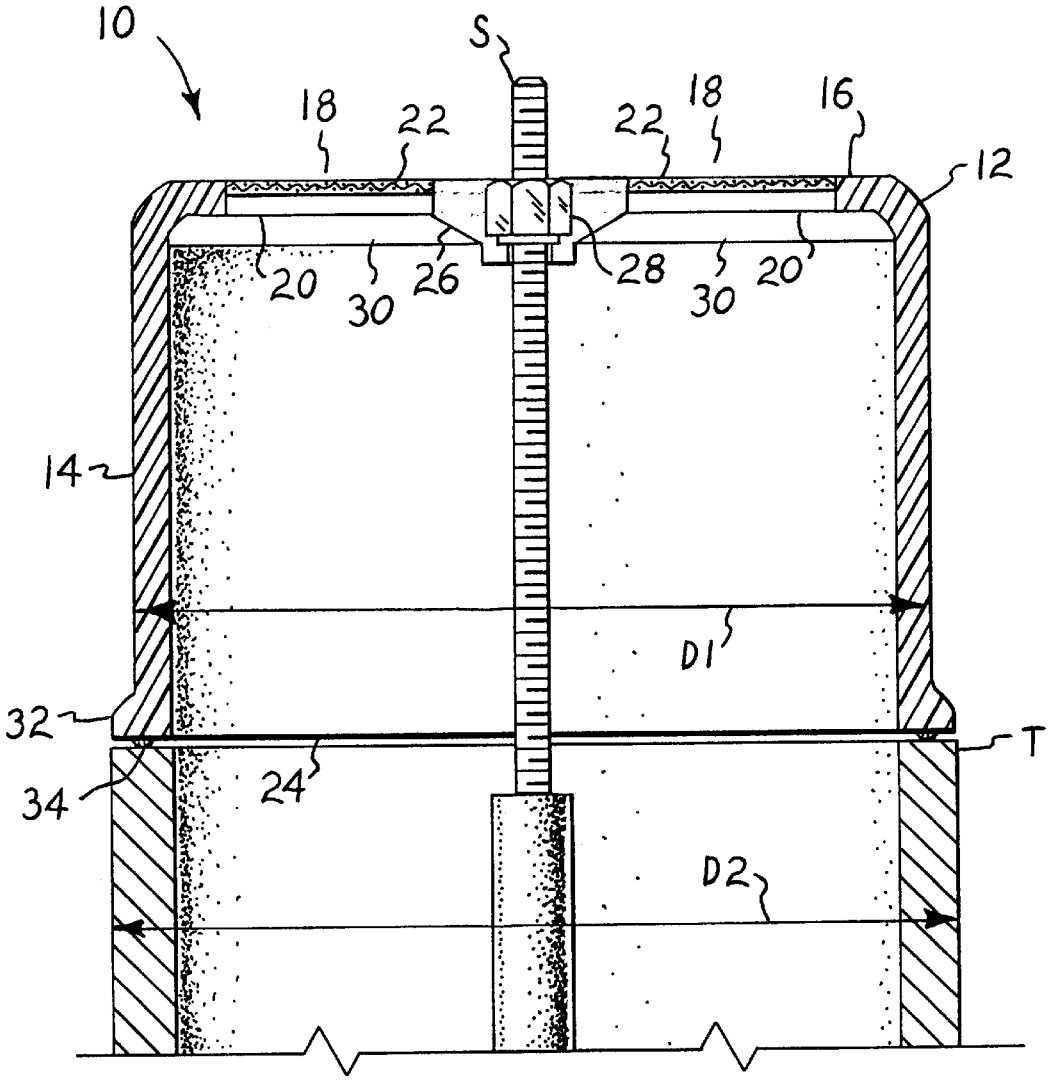
FIG. 3 is a side elevation view in section of the present cover and throat of a carburetor to which the cover is attached, showing additional details and attachment means.

FIG. 2 provides a bottom and side perspective view of the present filtered carburetor cover 10, showing further details thereof. The radially disposed ribs 20 converge at a central hub 26, which includes a nut 28 or other suitable carburetor attachment means imbedded or captured therein, for securing the carburetor cover 10 to the carburetor C, as shown in FIG. 3 and discussed further below. Each of the ribs 20 may have a generally T-shaped cross section, with a central stiffening member 30 formed along each rib 20 to provide sufficient strength for the compressing action of the fastener 28 as it is secured to the carburetor C.

The second or outlet end 24 of cover 10 includes a relatively wide base flange 32, which provides greater support for the cover 10 as it is secured tightly against the mouth of a carburetor, and provides greater resistance to distortion of the cover 10 as it is tightened down against the carburetor C. The flange 32 preferably includes a raised circumferential lip 34 extending therefrom, with the lip 34 having a semicircular cross section as shown clearly in FIG. 3 of the drawings. The lip 34 may be formed integrally with the cover 10 during manufacture, and may be formed of the same material (e.g., a plastic which is resistant to gasoline, alcohol, and similar fluids). The circumference of the lip 34 closely matches that of the carburetor throat, and bears against the edge of the carburetor throat to seal the cover 10 to the carburetor C, as shown in FIG. 3, to preclude the passage of any foreign matter at the juncture between the cover 10 and the carburetor C.

Figure 4:
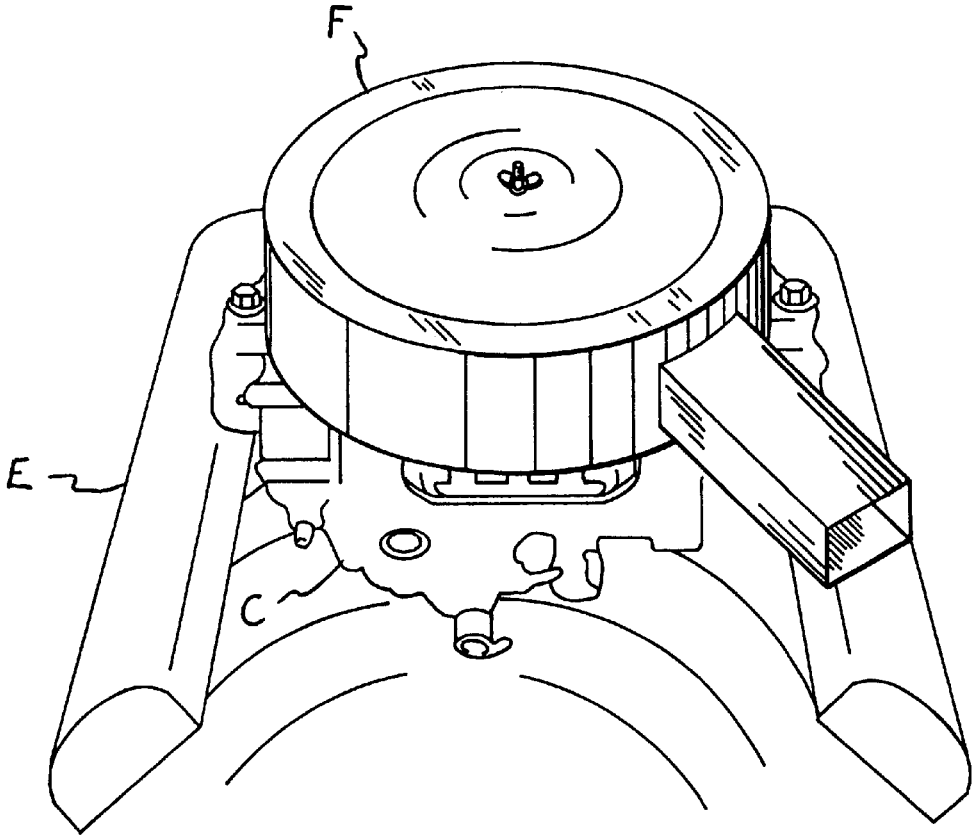
FIG. 4 (PRIOR ART)
FIG. 4 is a prior art drawing of a conventional carburetor air filter, showing the relatively large size and inaccessibility of the carburetor with such a prior art filter installed.

The cross section elevation view of FIG. 3 shows the present filtered carburetor cover 10 installed on the throat T of a carburetor. It will be seen that the carburetor cover 10 has a nominal diameter D1 which is substantially equal to (or perhaps slightly smaller than) the nominal diameter D2 of the carburetor throat T. Thus, little or no interference exists for a mechanic to access any externally adjustable components A on the carburetor C, as shown in FIG. 1. Conventional prior art air filter housings, as in the air cleaner or filter F of FIG. 4, are considerably larger in diameter and substantially obscure the carburetor, thereby precluding convenient access thereto for adjustments.

FIG. 3 also provides a clear illustration of the attachment of the present filtered carburetor cover 10 to the throat T of a carburetor. Conventional carburetors include a threaded air cleaner attachment stud S which is generally coaxial with the carburetor throat T. Conventional air cleaners, such as the air cleaner or filter F of FIG. 4, have a central passage therethrough which is larger than the major diameter of the threaded stud S. The central passage of the air filter housing F is placed over the central stud S, and a wing nut or the like is threaded onto the stud S to tighten the filter housing F against the carburetor.

The present filtered carburetor cover 10, with its captured nut or fastener 28, is threaded onto the conventional carburetor filter attachment stud S as an integral unit as shown in FIG. 3. The device may be tightened securely against the upper edge of the carburetor throat T, with the substantially similar diameters D1 and D2 of the housing 12 and carburetor throat T resulting in the sealing lip 34 of the cover 10 bearing tightly against the edge of the carburetor throat T to preclude entry of any foreign matter therebetween. The porous filter elements 22 allow air to flow through the inlet end 16 of the cover 10, through the carburetor, and into the engine so the engine may be operated with the present cover 10 in place. The small size of the cover 10 provides access to any components on the carburetor which may require adjusting while the engine is being operated.

In summary, the present filtered carburetor cover 10 provides a solution to the problem of tuning and adjusting the carburetor of an internal combustion engine while the engine is running, and simultaneously precluding the entry of dirt, dust, and other foreign matter into the engine intake system. Many such carburetor adjustments can only be done accurately when the engine is operating; otherwise, the mechanic can only guess at the proper setting when the engine is shut down, and then start the engine to check the adjustment. If the air cleaner is removed from the engine for access to the carburetor, and the mechanic wishes to preclude the entrance of any foreign matter into the engine intake system, then he must cover the carburetor throat during the time the air cleaner is removed for access to adjustments on the carburetor. This precludes the operation of the engine, when conventional covers or protective plates are used over the carburetor throat.

The present filtered carburetor cover may be installed for such adjustments, and left in place during operation of the engine. The filter elements in the upper or inlet end of the present cover, allow the engine to "breathe" during operation, so tuning and adjustments of the carburetor may be made and their accuracy determined instantly, as the engine is operating. While the present cover does not provide the filter area of conventional larger air cleaners, the relatively low power required of the engine during such tuning operations, where no significant load is being applied, do not require large volumes of air for operation.

The present cover may be manufactured in a number of ways, with injection molding or other similar processes being preferred for manufacturing the present cover from plastic material. Such a molding process also enables the filter elements to be bonded in place along their respective peripheries in the inlet end of the cover, thereby sealing them in place to preclude any leakage about their edges. The filter elements may be formed of any suitable porous material. Preferably, a single ply (or perhaps a few plies) of a finely woven metal screen material is molded in place across the inlet end of the cover at the time of manufacture for the filter element of the present carburetor cover. Most preferably, the metal is a corrosion resistant (i.e., "stainless") steel mesh, although other metallic screens (standard steel, brass, aluminum, etc.) may be used if so desired. Metal screen is preferred, due to its non-flammable properties in the event the engine spits back raw fuel through the carburetor throat during starting, and/or backfires through the carburetor throat. However, a single sheet (or additional plies, laminated together) of woven synthetic fabric material (e.g., polyester mesh) may be molded in place during manufacture to serve as the filter means, if so desired.

The use of plastic material,.and the integral bonding of the filter element(s) and attachment fastener in place during manufacture, results in a durable and sturdy device. The solvent resistant nature of the preferred materials, allows the filter element to be washed out or cleaned from time to time, as required. The present filtered carburetor cover will prove to be extremely useful to mechanics, pit crews, and others who have occasion to work on and adjust carburetor equipped vehicles, particularly in off road environments subject to dust, dirt, and other foreign matter in the air.

It is to be understood that the present invention is not limited to the sole embodiment described above, but encompasses any and all embodiments within the scope of the following claims.

What is claimed is:

1. A filtered carburetor cover for a carburetor having a nominal diameter, a throat, a centrally disposed air cleaner attachment stud, and at least one externally adjustable component thereon, comprising:

a housing having a nominal diameter substantially equal to the nominal diameter of the carburetor, for providing access to the at least one externally adjustable component of the carburetor when said housing is secured to the carburetor throat;

said housing including an impervious wall;

said wall having a first end including filtered airflow inlet means therein for filtering airflow therethrough;

said wall further having a second end opposite said first end, with said second end having an outlet opening for sealing against the carburetor throat and for passing airflow therethrough to the carburetor; and carburetor attachment means for temporarily and removably securing said housing to the carburetor;

wherein said second end of said housing includes a base flange having a width greater than said housing, for supporting said housing and resisting distortion of said housing when said housing is secured tightly to the carburetor.

2. The filtered carburetor cover according to claim 1, including:

sealing means disposed upon said second end of said housing, and;

said sealing means comprising a raised ridge having a circular cross section for sealingly bearing against the throat of the carburetor.

3. The filtered carburetor cover according to claim 1, wherein said filtered airflow inlet means comprises at least one sheet of woven synthetic material.

4. The filtered carburetor cover according to claim 1, wherein said filtered airflow inlet means comprises at least one sheet of a metal mesh screen material.

5. The filtered carburetor cover according to claim 1, wherein said housing is formed of plastic material.

6. A filtered carburetor cover for a carburetor having a nominal diameter, a throat, a centrally disposed air cleaner attachment stud, and at least one externally adjustable component thereon, comprising:

a housing having a nominal diameter substantially equal to the nominal diameter of the carburetor, for providing access to the at least one externally adjustable component of the carburetor when said housing is secured to the carburetor throat;

said housing including an impervious wall;

said wall having a first end including filtered airflow inlet means therein for filtering airflow therethrough;

said wall further having a second end opposite said first end, with said second end having an outlet opening for sealing against the carburetor throat and for passing airflow therethrough to the carburetor; and carburetor attachment means for temporarily and removably securing said housing to the carburetor;

wherein said first end of said housing includes a plurality of radially disposed ribs, and said first end of said housing and adjacent said ribs each defining an air flow inlet therebetween.

7. The filtered carburetor cover according to claim 6, wherein:

said first end of said housing includes four radially disposed ribs, with four air flow inlets alternatingly disposed with said ribs.

8. The filtered carburetor cover according to claim 6, wherein said carburetor attachment means comprises an internally threaded fastener captured at the center of said ribs, for securing said housing to the air cleaner attachment stud of the carburetor.

9. The filtered carburetor cover according to claim 6, wherein said filtered airflow inlet means is bonded into said ribs and said first end of said housing.

10. A carburetor and a filtered carburetor cover therefor, comprising in combination:

a carburetor having at least a nominal diameter, a throat, a centrally disposed air cleaner attachment stud, and at least one externally adjustable component thereon;

a filtered carburetor cover;

said cover having a housing with a nominal diameter substantially equal to said nominal diameter of said carburetor, for providing access to said at least one externally adjustable component of said carburetor when said housing is secured to said carburetor throat;

said housing of said cover including an impervious wall;

said wall having a first end including filtered airflow inlet means therein for filtering airflow therethrough;

said wall further having a second end opposite said first end, with said second end having an outlet opening for sealing against said carburetor throat and for passing airflow therethrough to said carburetor; and carburetor attachment means for temporarily and removably securing said housing to said carburetor.

11. The carburetor and filtered carburetor cover combination according to claim 10, wherein said second end of said housing includes a base flange having a width greater than said housing, for supporting said housing and resisting distortion of said housing when said housing is secured tightly to said carburetor.

12. The carburetor and filtered carburetor cover combination according to claim 10, including:

sealing means disposed upon said second end of said housing, and;

said sealing means comprising a raised ridge having a circular cross section for sealingly bearing against said throat of said carburetor.

13. The carburetor and filtered carburetor cover combination according to claim 10, wherein:

said first end of said housing includes a plurality of radially disposed ribs, and;

said first end of said housing and adjacent said ribs each defining an air flow inlet therebetween.

14. The carburetor and filtered carburetor cover combination according to claim 13, wherein:

said first end of said housing includes four radially disposed ribs, with four air flow inlets alternatingly disposed with said ribs.

15. The carburetor and filtered carburetor cover combination according to claim 13, wherein said carburetor attachment means comprises an internally threaded fastener captured at the center of said ribs, for securing said housing to said air cleaner attachment stud of said carburetor.

16. The carburetor and filtered carburetor cover combination according to claim 13, wherein said filtered airflow inlet means is bonded into said ribs and said first end of said housing.

17. The carburetor and filtered carburetor cover combination according to claim 10, wherein said filtered airflow inlet means comprises at least one sheet of woven synthetic material.

18. The carburetor and filtered carburetor cover combination according to claim 10, wherein said filtered airflow inlet means comprises at least one sheet of a metal mesh screen material.

19. The carburetor and filtered carburetor cover combination according to claim 10, wherein said housing is formed of plastic material.

* * * * *